United States Patent [19]

Soref

[11] Patent Number: 4,739,334

[45] Date of Patent: Apr. 19, 1988

[54] ELECTRO-OPTICAL BEAMFORMING NETWORK FOR PHASED ARRAY ANTENNAS

[75] Inventor: Richard A. Soref, Newton Centre, Mass.

[73] Assignee: The United States of America as represented by the Secretary of the Air Force, Washington, D.C.

[21] Appl. No.: 913,789

[22] Filed: Sep. 30, 1986

[51] Int. Cl.[4] ..... H01Q 3/22

[52] U.S. Cl. ..... 342/368; 342/200

[58] Field of Search ..... 342/368, 375, 108, 200, 342/374; 455/612, 609

[56] References Cited

U.S. PATENT DOCUMENTS

| | | | |
|---|---|---|---|
| 3,878,520 | 4/1975 | Wright et al. | 343/100 |
| 4,028,702 | 6/1977 | Levine | 342/374 |
| 4,241,351 | 12/1980 | Shreve | 342/368 |
| 4,258,363 | 3/1981 | Bodmer et al. | 343/16 R |
| 4,270,847 | 6/1981 | Meyer | 350/392 |
| 4,429,954 | 2/1984 | Caulfield et al. | 350/3.64 |
| 4,583,096 | 4/1986 | Bellman et al. | 342/368 |
| 4,620,193 | 10/1986 | Heeks | 342/368 |

*Primary Examiner*—Theodore M. Blum
*Assistant Examiner*—David Cain
*Attorney, Agent, or Firm*—Jules J. Morris; Donald J. Singer

[57] ABSTRACT

A fiber optic device 50 designed to steer the radiation beam of a phased-array antenna 10 has been demonstrated. A radio frequency (RF) signal is generated via photomixing at the output of a single-mode fiber optic interferometer. The phase of the electrical signal is shifted over several cycles in direct proportion to a voltage applied to an optical modulator 34, 60. The modulator consists of a Pockels-type optical phase modulator located in one arm of the heterodyne interferometer. Rapid changes in RF phase are feasible. A miniature low-voltage version of the device 50, 72, based upon integrated optics, has been devised.

17 Claims, 5 Drawing Sheets

ELECTRO-OPTICAL BEAMFORMING NETWORK FOR PHASED ARRAY ANTENNAS

STATEMENT OF GOVERNMENT INTEREST

The invention described herein may be manufactured and used by or for the Government for governmental purposes without the payment of any royalty thereon.

TECHNICAL FIELD

This invention relates to electronically steering radio transmissions and is particularly related to the application of integrated optical networks to control beamforming by phased array antennas.

BACKGROUND OF THE INVENTION

Microwave transmission and reception by phased array antennas is increasingly used for radar, communication and data transmission. This is because phased array antennas have many advantages over older conventional antennas. The phased array antennas make use of an array of fixed individual radiators to produce electronically steered signals that are only decipherable in a preferred direction when the signal arrives with a coherent wavefront. Further, the directionality of the beam lends itself to use with radar detectors in order to pinpoint aircraft position. Such radars are commonly used for air traffic control. The advantages of using phased array antennas may be summarized as permitting pinpoint radar detection without moving antenna systems, providing voice and data communication to a desired receiver rather than in a general broadcast and permitting extremely fast and agile changes in radio beam direction.

The main drawback to increased successful use of phased array antenna systems stems from their use of costly and bulky conventional microwave radio frequency phase shifters. The systems currently used to provide coherently steered signals from arrays of individual radiators are extremely complicated and expensive electronic devices. This is because large numbers of electronic phase shifters (one for each individual radiator) are required to drive the antenna. The driving circuitry of electronic phase shifters is quite complex and requires relatively large amounts of electric power for programmed operation of phased array scanning and beamforming.

An attempt to utilize optical devices in place of conventional phase array control devices is disclosed in U.S. Pat. No. 3,878,520 to Wright et al. The Wright device, if operable, describes a scheme utilizing a bulk optical pattern to vary spatial beam position. An optical pattern is created at an optical to microwave converter (56) by light into apportioned light pipes which are controlled by a light valve control to produce a desired light pattern gated at a microwave frequency. Wrights' free space optical phase processor is shown in FIG. 9 of the subject patent.

While the optic approach of the Wright device may be an advance in the art of phased array signal generation, it unfortunately has considerable disadvantages as a practical device. The Wright device uses one large optical mixer as an optical phase processor. Light is captured in an array of gated light pipes which are selectively controlled to provide an image at a lens. This process is very wasteful of light (only 10–20 percent will probably proceed through the light pipes) and relies on optical beams propagating in air. This can be inaccurate and subject to disruption from dust and vibration. The microwave beams are steered physically by gating the light pipes selectively. Finally, it is unlikely that the Wright device can produce more than a small, limited number of antenna beam positions.

In summary, the Wright device does display some of the advantages of using an optic approach, such as use of fiber optic filaments, however, the complex and sensitive means provided for optical phase processing must be considered a low efficiency and somewhat clumsy mechanism.

In view of the above a need is apparent for an improved, preferably optical, beamsteering device for a phase array antenna.

It is therefore an object of this invention to provide a complete optical beamforming network for generating signals that excite a phased array antenna system to produce a desired directionally controlled microwave beam.

It is further an object of this invention to provide a straight forward and inexpensive electrooptical device which forms an optical microwave phase shifter capable of producing zero to greater than $2\pi$ of electrical phase in the microwave output.

It is yet another object of this invention to provide an optical phase shifter for phased array antenna steering that is substantially more compact than conventional structures and is suitable for inclusion in an integrated optical circuit.

It is still another object of this invention to provide a phase shifter structure through which light is completely guided by single mode optical fibers and suitable channel waveguides.

Finally, another object of this invention is to provide for an inexpensive electrooptical arrangement which can be mass produced for use with phased array antennas.

SUMMARY OF THE INVENTION

The invention comprises a fiber optic device designed to steer the radio beam of a phased array antenna. A radio frequency signal is generated via photo mixing at the output of a single mode fiber optic interferometer. The phase of the electric signal is shifted over several cycles in direct proportion to a voltage applied to an optical controller. The controller comprises a Pockels-type optical phase modulator located in one arm of the heterodyne interferometer. Rapid changes in radio frequency phase are feasible with this arrangement. A miniature low voltage version of this invention based upon integrated optics is also included as an aspect of this invention.

A preferred embodiment of this invention can be considered to be an optically steered antenna comprising an array of individual microwave radiators each driven by an electronic microwave driver. A network of optical phase shifters for supplying a control signal to each of said electronic microwave drivers is used to generate microwave radiation at the microwave radiators. An array processor computer is used for controlling the network of optical phase shifters to produce directed microwave radiation with the antenna.

In the preferred embodiment of the invention each of the optical microwave phase shifters comprises several individual elements. A laser light source is used for generating a coherent lightwave having a phase and a frequency along a primary optical path. An optical path divider is used to divide the light from the primary optical path into a first and a second optical path. An optical frequency shifter is associated with the first optical path for conforming the light along that path to the desired antenna radiation frequency. A stable microwave oscillator is provided for driving the optical frequency shifter at the antenna radio frequency. Along the second optical path an optical phase modulator is used to selectively advance or retard the phase of the light along that path. After proceeding through these devices light from the first and second optical paths is superimposed in a spatial and temporal combination. This combined optical path proceeds to a photodetector which converts light interference pulses into electronic pulses. These electronic pulses are used to drive the individual radiator elements of the antenna.

In a preferred embodiment of the antenna the electronic pulses from a multitude of optical microwave phase shifters are used to beamform a microwave transmission at the phased array antenna.

In yet another embodiment of the invention an auxiliary optical phase modulator is used to trim the output phase of each optical microwave phase shifter.

In still another embodiment of the invention the optical microwave phase shifters are combined on a integrated optical circuit with optical waveguides. Optical signals are delivered to and taken from the integrated optical circuit by means of single-mode optical fibers.

In yet another embodiment of the invention the optically steered antenna further comprises a receiver mode system for receiving and identifying by direction incoming microwave radiation. The receiver mode system comprises electronic modules for amplifying received microwave signals from each of said individual microwave radiators and a receiver network of optical phase shifters. A direction finding computer is used to initialize the phases of the optical phase shifters of the receiver in order to determine the directional origin of the incoming microwave radiation. Photooptical detectors are used to convert the output signals from the optical phase shifters to electronic pulses. A receiver computer is used for interpreting the electronic pulses generated by the photooptical detectors in order to analyze or retransmit the incoming signal.

BRIEF DESCRIPTION OF THE DRAWINGS

The foregoing and other objects and advantages of the invention will be apparent from the following more particular description of the preferred embodiments of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE INVENTION

Present day phased array antennas are controlled by microwave phase shifters that are fairly lossy, bulky and expensive. In the version of a phased array antenna described herein, conventional phase shifters are replaced by small low powered devices that serve to eliminate conventional bulky microwave guides. The optical/microwave antenna herein described is a novel phased array antenna that uses fiber optic transmission lines in the antenna feed in lieu of microwave guides. This hybrid antenna offers improved signal control throughout the components.

Figure 1:
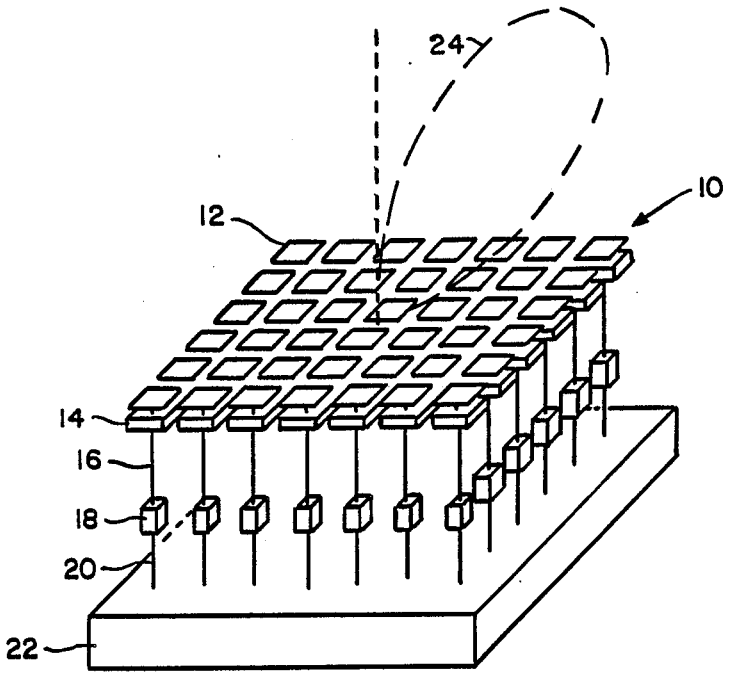
FIG. 1 is a conceptual perspective view of a phased array radar system.

FIG. 1 shows schematically a phased array antenna 10. The antenna comprise an array of individual radiating elements 12. Each of these elements is associated with an electronic module 14 which amplifies a signal to be radiated by the radiating element 12. In this embodiment of the invention the electronic module 14 would include an optical detector for converting an optical signal from fiber optic line 16 into an electronic signal. This optical signal is generated by an optical microwave phase shifter 18, for the purpose of the schematic, the optical microwave shifters 18 are shown individually but they can comprise a single or several integrated optical circuits with individual outputs to each electronic module 14. Optical microwave phase shifters have an electrical line 20 to an array processor or controller 22. Controller 22 preferably comprises a digital electronic computer which is connected to the N X M matrix of individual radiators 12. There is one electronic module for each of the N X M radiant elements 12 in the array and each module contains a microwave amplifier.

Shown in dotted lines above the array of individual radiating elements 12 is a schematic representation of a directional microwave beam 24 formed by the individual radiators 12. Radiation beam 24 is formed using a set of electrooptical microwave phase shifters 18. The phase shifters deliver an optical signal to the electronic module where a photodiode converts the optical signal to a low energy microwave signal. The phase related microwave signal is then amplified and radiated. This modular optical/microwave antenna could also be operated in the receiver mode as is described below.

The key element in the optical microwave system described above is a novel voltage controlled radio frequency/microwave phase shifter. A radio frequency electrical signal is generated by square law mixing of optical signals from a heterodyne interferometer in which the radio frequency (RF) phase is shifted in proportion to a voltage applied to a Pockels-type optical phase modulator. The modulator is located in one arm of the interferometer. It may be thought that it is difficult to obtain adequate RF phase shift with an optical perturbation because the RF wavelength is approximately $10^6$ longer than the optical wavelength. Nevertheless, as shown below $2\pi$ rad of optical phase modulation will produce an immediate shift of $2\pi$ rad in the electrical phase angle. The heterodyne design discussed below has been confirmed with experimental results on free space and fiber optic interferometers. This invention is preferably constructed, however, on an integrated optical (IO) chip. Since the phase shifter could be built on a 1 by 2 centimeter chip, monolithic integration of several low voltage shifters on one chip is feasible. Details of the integrated optical circuit are also given below.

II THEORY

An optical Mach-Zehnder heterodyne interferometer 28 (FIG. 2) contains an optical frequency translator 30 to upshift or downshift the initial light frequency. The frequency offset can be in the RF range, for example. If the interferometer output is fed to a square-law detector 32 (a conventional photodiode), an RF beat note will be observed. Now, if an electrooptical phase modulator 34 is inserted into either arm of the interferometer, it is possible to control the phase of the electrical beat note by controlling the optical phase. This property has not been generally appreciated.

Figure 2:
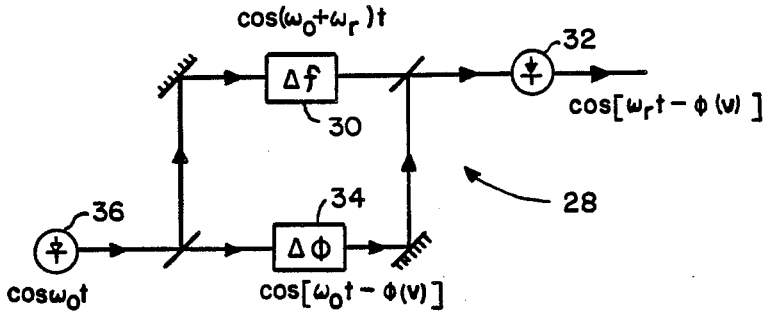
FIG. 2 is a schematic representation of a Mach-Zehnder heterodyne interferometer.

FIG. 2 illustrates how an electrical signal is produced by coherent mixing of two light signals. At the interferometer input, the CW light beam from the coherent source 36 is divided into equal signals of the form $(A_o/\sqrt{2})\cos\omega_o t$, where $\omega_o$ is the optical frequency and $A_o$ is the optical source amplitude. In the first arm, a single-sideband optical frequency shifter 30 operating at the radio frequency $\omega_r$ modifies the first optical signal into $(A_o/\sqrt{2})\cos(\omega_o+\omega_r)t$. In the second arm, a voltage-controlled optical phase shifter (modulator) 34 retards the optical phase by an amount $\phi_2(V_2)$, which changes the second optical signal into $(A_o/\sqrt{2})\cos(-\omega_o t+\phi_2(V_2))$. (For the time being, we shall assume that $\phi_2(V_2)$ is not time varying.) At the interferometer output, the total optical electric field $E_t$ is $(A_o/\sqrt{2})[\cos(-\omega_o t+\omega_r t)+\cos(\omega_o t+\phi_2(V))]$. The detector 32 response is proportional to the time average of $|_t|^2$ over an optical cycle. Therefore, the observed photovoltage is $$V_{out}=constX\ (A_o^2/2)[1+\cos(\omega_r t-\phi_2(V_2))] \quad (1)$$

a signal that consists of a dc term and an RF term. Let us consider only the $\omega_r$ term in (1), as in an ac-coupled detector. If a voltage step $V_2$ is applied to the optical phase modulator 34 so as to produce a specific amount of optical phase retardation (several cycles, for example), then the RF electrical phase is shifted by the same amount. This is the principal result. Regarding the optical polarization states within the interferometer, we can decompose the light in each arm into orthogonal polarization components labeled $s_1$, $p_1$ and $s_2$, $p_2$. (The reference plane for s and p is determined by the frequency shifter). At the interferometer output, we note that $s_1$ mixes with $s_2$, and that $p_1$ mixes with $p_2$. However, $s_1$ does not interfere with $p_2$, nor does $p_1$ interfere with $s_2$. In FIG. 2, the Mach-Zehnder arrangement, it is assumed that the optical path lengths of the two arms are nearly the same, and that the path difference is less than the coherence length of the optical source.

Figure 3:
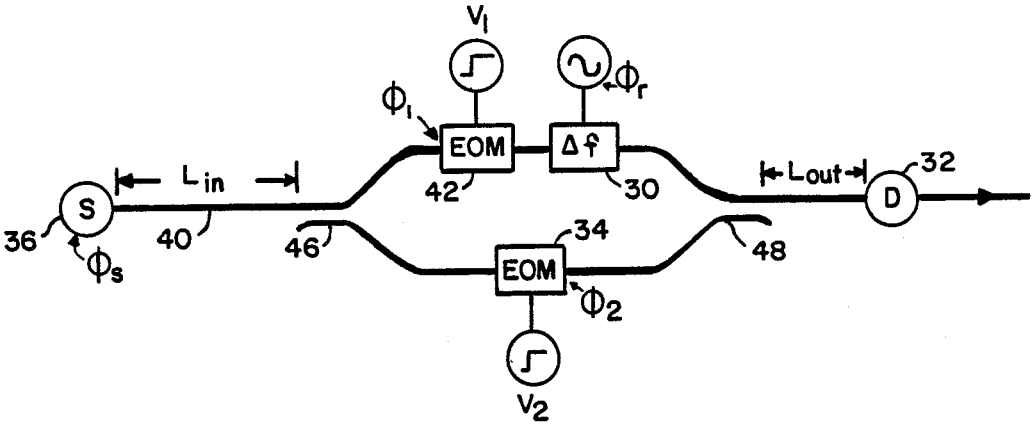
FIG. 3 is a generalized guided wave heterodyne interferometer which incorporates the principles of this invention.

Having described the RF (radio frequency) phase shifter in its simplest terms, it is now possible to examine the more general RF phase shifter of FIG. 3. First, we introduce fiber-optic transmission lines 40 to carry light from the source to the interferometer and from the interferometer to the photodiode. Second, an additional electrooptic phase modulator $\phi_1(V_1)$ 42 is inserted in series with the frequency shifter 30 element for "phase trimming." Third, we now recognize that there are initial phase angles associated with the optical source $(\phi_s)$ 36 and with the optical frequency shifter $(\phi_r)$ 30. Fourth, we note that the frequency translation process is characterized by an efficiency factor $\eta$. (Implicit in n is an RF drive level).

FIG. 3 illustrates the general case. The propagation constants of the fiber-optic transmission lines are $\beta_o$ at the frequency $\omega_o$ and $\beta_{or}$ at the frequency $\omega_o+\omega_r$. The fiber line lengths are $L_{in}$ and $L_{out}$, respectively. Note that the phase angle $\phi_r$ of an RF oscillator 44 driving the frequency shifter 30 is transferred directly from the electrical domain to the optical domain. This follows from the nature of the physical interaction. For example, if the frequency-shifting is done acoustooptically, it can be shown that there is a one-to-one correspondence between the phase angle of the traveling acoustic wave and the phase angle of the diffracted optical wave. There are static optical phases $\psi_1$ and $\psi_2$ associated with the first and second paths in the interferometer. This occurs because one path may be slightly longer than the other, and because there is a 90° relative phase shift between the two optical signals that emerge from an optical directional coupler 46. (The 90° shift applies to both couplers 46, 48 in FIG. 3).

Proceeding with the analysis of FIG. 3, we note that the two optical waves entering the interferometer are both of the form $\cos(\omega_o t+\phi_s+\beta_o L_{in})$ with amplitude $A_o/\sqrt{2}$. After traversing the interferometer, the two signals are $(\eta A_o/\sqrt{2})\cos(\omega_o t+\phi_s+\beta_o L_{in}+\omega_r t+\phi_r+\psi_1+\phi_1(V_1))$ and $(A_o/\sqrt{2})\cos(-\omega_o t+\phi_s+\beta_o L_{in}+\psi_2+\phi_2(V_2))$, respectively. Each lightwave picks up an additional phase, either $\beta_o L_{out}$ or $\beta_{or}L_{out}$, as it travels to the photodiode 32. Thus, at the detector, the combined optical E-field is $$E_1 = (\eta A_o/\sqrt{2})\cos\Phi_1 + (A_o/\sqrt{2})\cos\Phi_2$$

where $$\Phi_1=(\omega_o+\omega_r)t+\phi_s+\beta_o L_{in}+\phi_r+\psi_1+\phi_1(v_1)-+\beta_{or}L_{out} \quad (2)$$

and $$\Phi_2=\omega_o t+\phi_s+\beta_o L_{in}+\psi_2+\phi_2(V_2)+\beta_o L_{out}.$$

The calculation of $<|E_t|^2>$ then gives the following result for the detector signal:

$$V_{out}=const\times(A_o^2/4)[\eta^2+1+2\eta\cos(\Phi_1-\Phi_2)]. \quad (3)$$

Only the difference frequency term $\cos(\Phi_{1-\Phi 2})$ is found in the ac-coupled output, and in the $\Phi_{1-\Phi 2}$ phase difference, the phase components $\beta_o L_{in}$ and $\phi s$ are subtracted out. Thus, we obtain from equations (2) and (3) the RF result:

$$V_{out}=const\times(\eta A_o^2/2-)\cos[\omega_r t+\phi_r+\phi_1(V_1)+\phi_2(V_2)+\Delta\psi-\Delta\beta L_{out}] \quad (4)$$

where $\Delta\psi=\psi_1-\psi_2$ and $\Delta\beta=\beta_{or}-\beta_o$. Now, the RF phase is controlled by the phase difference phrase is controlled by the phase difference between the optical phase modulators (34, 42)$\phi_1-\phi_2$ and by $\phi_r$. The $\phi_1$ modulator, or trimmer, 42 affords an extra degree of freedom because it can be used to synchronize several shifters. For example, if $L_{out}$ differs from a standard length, then the trimmer 42 can compensate for this deviation and can "initialize" a given shifter. More generally, the trimmer would be set to compensate for both phase errors: $\phi_1(V_1)+\Delta\psi+\Delta\beta L_{out}=0$. Also, for Pockels-type controllers (i.e., phase modulator 34), $\phi_2=kV_2$ and the RF output phase will be linear in voltage. Amplitude control of the RF output signal is available by controlling the optical source amplitude, or the RF input level, or the conversion efficiency, or a combination thereof. The above theory predicts that the RF output phase will be invariant with respect to the input transmission-line length and to the optical source phase.

Thus far, $V_1$ and $V_2$ at electrooptical phase modulators 34, 42 have been assumed to be steady (dc) potentials, but a time-dependence is implicit in $V_1$ and $V_2$. Fast switching of the RF phase angle can be attained with a rapid stepwise transition from one level to another (e.g., $V_2$ to $V'_2$) which represents "digital" control. Or, a continuous "analog" change in phase is feasible. It is relatively easy to control the voltage levels $V_1$ and $V_2$ accurately. Therefore, one can obtain high accuracy RF/microwave phase control, and the accuracy may be better than that offered by conventional microwave phase control methods.

These results are further substantiated by the experimental results reported in the article "Voltage Controlled Optical/RF Phase Shifter" by Richard A. Soref in the Journal of Lightwave Technology, Vol. LT-3, No. 5, dated October 1985 (issued Oct. 22, 1985) which are incorporated herein by reference.

INTEGRATED OPTICAL STRUCTURE

A compact low-voltage embodiment of the RF phase shifter described above can be used in an operational optical/microwave antenna. Fiber-coupled integrated optical devices are well established, therefore, an integrated optical (IO) structure (FIG. 4) is an excellent candidate for the miniature phase controller. The stability of this interferometer and the resulting stability of the RF/microwave beat signal are the main motivations for selecting the IO approach. Temperature variations and other environmental factors have an equal effect on each path in an integrated interferometer because the paths share a common substrate. Hence, a net cancellation or "common mode rejection" of phase-drift factors occurs at the output coupler of the interferometer. Experimental evidence for such stability has already been found.

The IO chip 50 contains channel waveguides 52 in a Mach-Zehnder layout and is coupled to single-mode fibers 54 at both input and output. These fibers can be polarization preserving or not, depending upon the modal properties of the active elements. The fiber cores are aligned precisely with the IO channels by means of V-grooves 56 formed in a preferentially etched Si substrate 58. The materials used in the 10 circuit can be III-V semiconductor materials or dielectric materials such as single-crystal $LiNbO_3$. In the latter case, Ti-diffused channels can support TE modes, TM modes, or a TE-TM combination.

There are several viable choices for the active elements. Although it is possible to use surface acoustic waves to diffract and upshift light in a slab guide, we use a channelized all-electrooptic approach to frequency shifting. There are three recent examples suitable of channel-type electrooptic frequency shifters 60 disclosed in the 10 literature: 1) a traveling-wave three-phase TE-to-TM mode converter (L. M. Johnson, R. A. Becker, and R. H. Kingston, "Integrated optical channel waveguide frequency shifter," presented at 7th Topical Meet. on Integrated and Guided Wave Optics, Kissimmee, Fla., Apt. 25, 1984, paper WD4-1,) 2) a four-branch TM mode structure containing balanced electrooptic modulators (M. Izutsu, S. Shikama, and T. Sueta, "Integrated optical SSB modulator/frequency shifter," IEEE J. Quantum Electron. Vol. QE-17, p. 2225, 1981), and 3) a traveling-wave 2-phase TE-to-TM mode converter that has a comb-like appearance (F. Heisman and R. Ulrich, "Integrated optical frequency translator with stripe waveguide," Appl. Phys. Lett. Vol. 45, p. 490, September 1984). The electrooptic phase shifter 62 in a $LiNbO_3$ wafer can consist simply of a parallel-pair of electrodes that straddle a channel-guide so as to modify its propagation velocity with an applied E-field. In the IO devices mentioned here, the maximum operating voltages are approximately 50 V, and $10^9$ switching operations per second are feasible.

Figure 4:
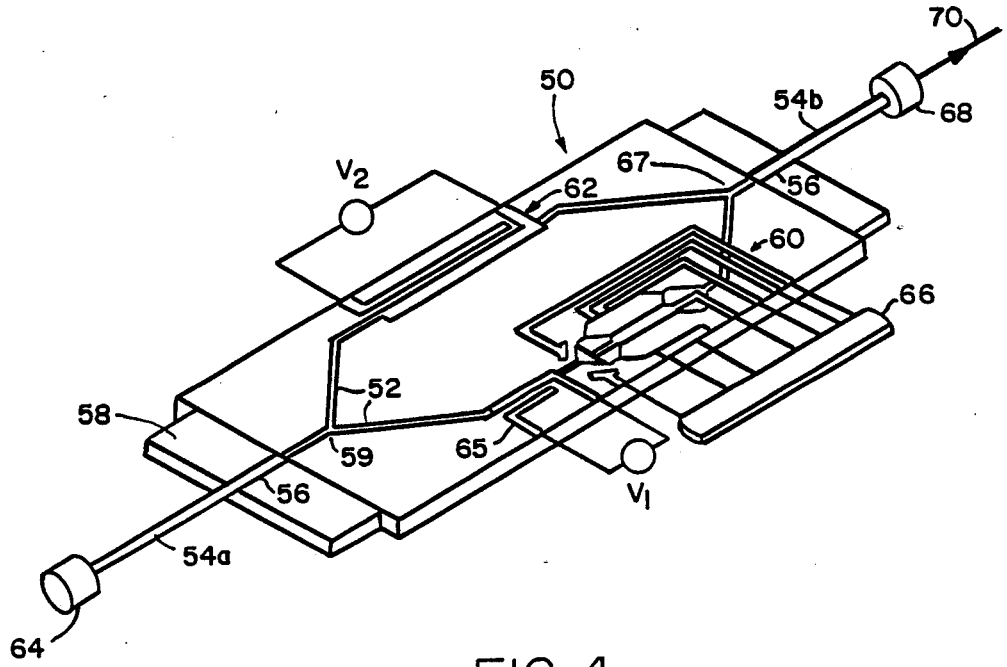
FIG. 4 is a perspective representation of an integrated-optical embodiment of an optical radio frequency phase shifter.

At the output Y-branch coupler 59 of the IO structure, TE modes interfere only with TE modes, and TM modes only with TM. Because of this design constraint, it is simplest to choose an all-TM-mode approach for the IO circuit, rather than to select a design that supports TE and TM. FIG. 4 shows the $TM_o$-mode integrated optic structure that uses the four-branch frequency shifter of Izutsu et al in z-cut $Ti:LiNbO_3$. The various control electrodes are shown. To utilize the $r_{33}$ electrooptic coefficient, one electrode of each pair is deployed atop the channel to produce z-components in the applied field.

The IO structure of FIG. 4 operates in the same manner as the structure of FIG. 3. An optical input signal is generated by a single mode laser diode 64 and routed by fiber optic cable **54*a* to IO chip 50 where it is divided into wave guides 52. One path of the signal passes through optical phase modulator 62. The second optical path directs the signal through a phase modulating trimmer 65 and then through the single side band frequency shifter 60 which is driven by a stable microwave oscillator and controller 66 for selecting different voltages for optical frequency translation. The two signals are then combined at coupler 67 and transferred to a fiber optic cable 54*b* to an optical detector 68 which translates the signal to an RF/microwave electrical signal 70. The theoretical basis is the same as described above and desired microwave signal is developed at output 70**.

The electrooptic technique for controlling the phase and amplitude of an RF/microwave electrical signal has been fully described. The technique includes a heterodyne optical interferometer with a Pockels-type optical phase modulator in one path. Accurate, multicycle control of the RF phase angle is afforded by applying an accurate voltage step to the modulator. The controller can change the RF phase angle very rapidly, for example, in a few nanoseconds, and the phase shifting device is fiber coupled for remote transmission of high-frequency signals. With the aid of integrated-optical technology, it is possible to build the phase shifter on a small "chip" coupled at both ends to single mode fibers. In addition to miniaturization, this monolithic optical structure has a number of advantages over the fiber-optic inteferometer initially described, these include lower-voltage control, faster switching, and greater stability with respect to environmental factors that can lead to phase drift. A group of these integrated shifters can be used for electronic beamsteering of a phased-array antenna.

Figure 5:
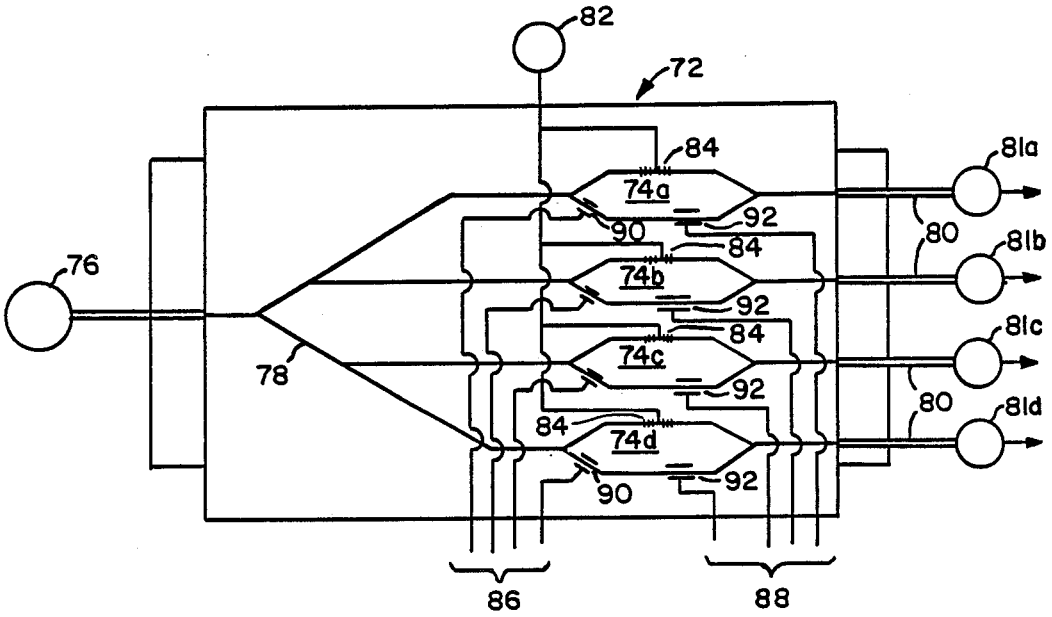
FIG. 5 is a schematic representation of an integrated optical structure having four phase shifters.

FIG. 5 shows four shifters 74*a, b, c, d* monolithically integrated side-by-side on the same IO chip 72. The shifters are optically actuated by one optical source 76 with a planar, single-mode, integrated 1×4 power divider (a star coupler) 78 as shown. (By adding more branches to this star, one could get 1×16 division, or higher order division, if desired). There is one output fiber 80 for each shifter to individual photodiodes 81*a, b, c, d.* These output fibers should have the same length in order to minimize initial phase differences between radiating elements.

A single microwave oscillator 82 supplies the optical frequency shifters 84. There is a uniformity requirement on the microwave phase supplied to the N microwave inputs (of the N IO chip frequency shifters 84) on the wafer of FIG. 5. To ensure phase uniformity, one can use a microstrip transmission line to connect all four in FIG. 5, and adjust the line lengths on the chip by the initial construction (e.g., the photolithographic masks) so as to obtain the same 100 $_{om}$ for each shifter. Multiple voltage supplies 86, 88 control trimmers 90 and phase modulators 92.

For the electrooptic phase modulators 92, the circuit capacitance and resistance would probably be large enough to limit the switching speed, possibly restricting the rise and fall times of the Pockels effect phase modulators 92 to something like one microsec. However, this shifter 72 is inherently capable of less than one nanosec response.

The integrated multi-shifter IO chip of FIG. 5 is the building block for the complete antenna system. Generally, we want to have an antenna that operates in both the receive and transmit modes. We shall show a system diagram for each mode, and then note that those systems can be immediately combined to get a transmit and receive (T+R) antenna.

Figure 6:
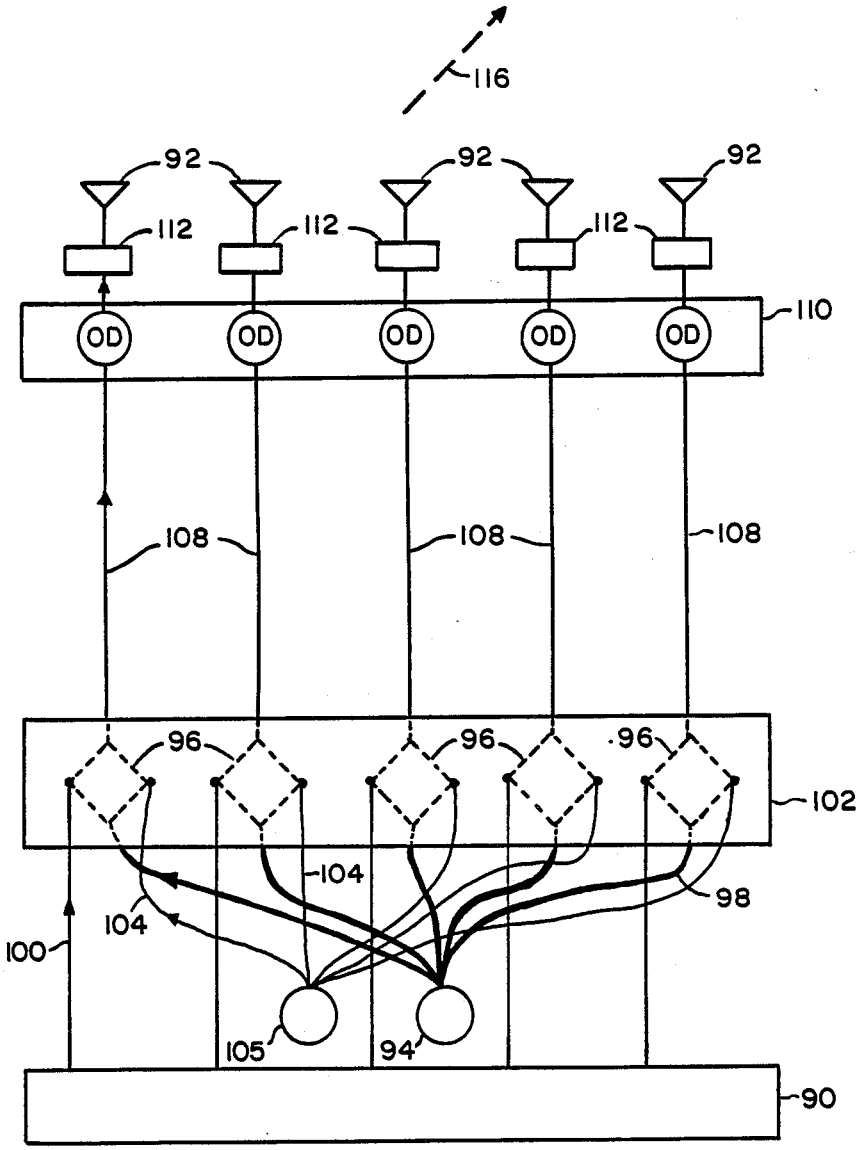
FIG. 6 is a schematic representation of an electronically controlled array of a phased array transmitter incorporating electrooptical components of this invention.

For the transmit mode, FIG. 6 shows schematically a digital electronic array processor 90 (computer) that controls an electronically steered array of microwave radiating elements 92 emitting a directed microwave beam 115. The computer is connected to the radiators as follows. One optical source 94 feeds several integrated optic phase shifters 96 on IOC chip 102 by means of single mode fibers 98, and multiple electrical wires 100 connect the computer 90 to the optical phase controls of the phase shifters 96 on the IO chip 102. There are also multiple microwave transmission lines 104 coming from a microwave (oscillator) source 105 to the IO chip. Multiple single-mode output fibers 108 travel in parallel from the IO chip to a detector bank 110 at the antenna plane. The detector bank comprises photodetectors for converting the output optical signals to electrical microwave pulses. The detector bank drives the microwave electronic modules 112 located at the plane. (Those modules contain microwave amplifiers, circulators, etc). The antenna beam 115 is formed by appropriate microwave phase shifts emanating from the IO chip 102 and amplified by electronic modules 112.

These microwave phase shifts are controlled by the array processor 90 which controls voltage in leads 100 to phase modulators on the individual optical phase shifters 96 of the IO chip 102. The voltage pattern is controlled by appropriate computer software which is conventional in nature and largely common to conventional phase array systems.

Figure 7:
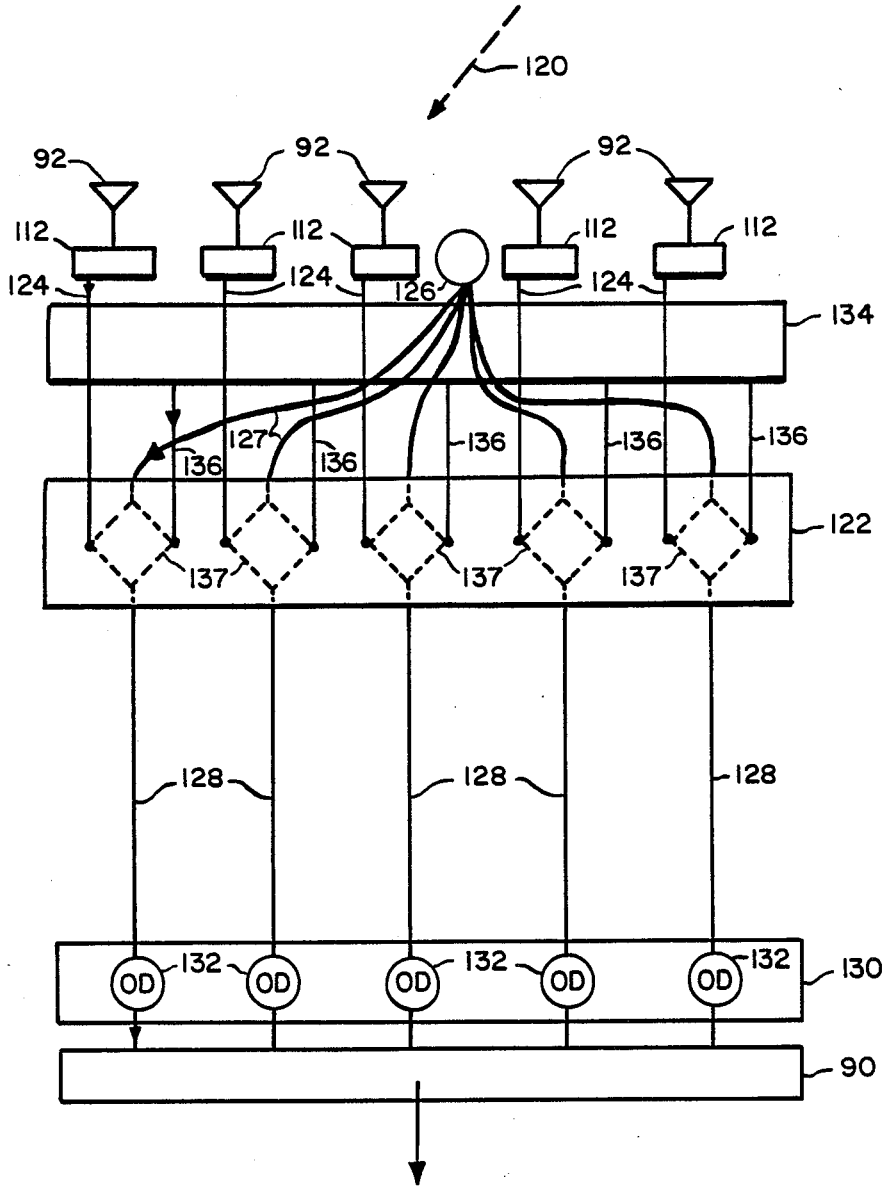
FIG. 7 shows in schematic form a receiving mode antenna system incorporating the electrooptical components of this invention.

Finally, in FIG. 7, we show the receive-mode antenna system, which has the same array processor computer 90 as in FIG. 4, and the same radiant elements 92 (which are receptor/radiators here). Those receptors generate multiple microwave signals, subsequently amplified by the modules 112, and those signals have a definite phase relationship for each "direction in the sky" of incoming beam 120 (shown schematically). The incoming phases are found mathematically by assuming an incoming microwave plane wave from a particular direction, or angle $\theta$, as detailed below.

Those microwave signals are transported to the large scale integrated optic (IO) chip 122 by microwave microstrip lines 124 for optical frequency shifting with various "injected" phase angles $\phi_{om}$. As before, the IO chip 122 is driven from one optical source 126 over multiple single mode optic fibers 127 (and this source 126 exists in addition to the transmit source of FIG. 6). As before, there are multiple parallel single mode fibers 128 from the receive mode IO chip 122 that go to a receive mode detector bank 130 (multiple photodiodes 132) located at the array computer. Note that an additional electronic computer 134 is required to control the various optical phases $\phi_{ol}$ in the large scale integrated optical chip (LSI-IOC). We shall call this the directional-finding DF computer 134. There are multiple wires 136 from this DF computer 134 that go to the IO chip.

The DF computer 134 does two things: it initializes the phases $\phi_{oo}$ and it sets the N phases $\phi_{ol}$ at optic phase shifters 136 to "look at" a particular direction in the sky. To understand this, consider the total microwave signal that is received. The total microwave voltage is the sum of N subsignals $\cos(\omega_m t+\phi_{om}{}^i-\phi_{ol}{}^i)$, and the array computer 90 gives the total voltage $S_r$. If, as in FIG. 5 we choose the ensemble of phase angle $\phi_{ol}$ as we would for transmitting in the $\theta$ direction, then in the receive mode we will have an equality between those angles and the incoming microwave phase angles in the $\theta$-receiving direction: $\phi_{om}{}^i=\phi_{ol}{}^i$ for all i, and $S_r$ will be a maximum at this $\theta$ -direction and will be "washed out" at all other directions. This means we will have reception in the $\theta$ -direction.

As a final comment, we will consider the optical sources that are used in the antenna system. We can have one source 126 driving everything, for example, a 20 mW cw laser diode whose output is divided up in N ways (which would lead to a few microwatts of power in each optical feed line). Or, we can have multiple laser diode sources to provide optical excitation to the IO chip.

Rapid electronic beamsteering is an important goal for the phased-array antenna of the future. Time-delay beamsteering and phase-shift beamsteering are the two main approaches. This invention is concerned with the phase-shifting approach. For antennas with an instantaneous microwave bandwidth of 2 percent or less, phase shift steering will give accurate beampointing.

The phase controllers here are based on the Pockels effect, which is inherently quite fast. In the electrooptical modulators, circuit restrictions on switching speed could be minimized by utilizing a guided-wave structure discussed above with traveling-wave electrodes. Thus, it should be possible to alter the RF/microwave phase angle in less than 1 ns. Therefore, the phase shifters of the present invention offer highly agile, electronic beamsteering in an optical/microwave antenna.

While the invention has been particularly described with reference to the preferred embodiments thereof, it will be understood by those skilled in the art that various changes in substance and form can be made therein without having departed from the spirit and the scope of the invention as detailed in the attached claims. For example, this device should not be limited to microwave phased array radar but is more broadly applicable to phased array radio communication.

I claim:

1. An electrooptical radio frequency phase shifter comprising:
(a) a single mode laser providing a light source for the phase shifter;
(b) a signal divider for dividing the laser light into first and second parts that travel along different routes;
(c) an optical frequency shifter driven by a radio wave oscillator for producing a frequency offset in the first part of the laser light conforming to a desired antenna radiation frequency;
(d) an optical phase modulator for changing the optical phase of the second part of the laser light;
(e) signal combining means for combining the first and second parts of the laser light in order to superimpose the two parts; and
(f) a photodetector that produces an electrical signal that is proportional over time to the light generated by the superimposed parts of the laser light and which produces a radio frequency signal.

2. The electrooptical radio frequency phase shifter of claim 1 wherein the desired antenna radiation frequency is in the microwave range.

3. The electrooptical radio frequency phase shifter of claim 1 further comprising an auxiliary optical phase trimmer associated with one of said divided parts of said laser light for trimming the output phase of the optical radio frequency phase shifter.

4. The electrooptical radio frequency phase shifter of claim 2 further comprising an antenna for radiating the radio frequency signal from said photodetector.

5. The electrooptical radio frequency phase shifter of claim 4 wherein said antenna comprises a phased array antenna for suitable beamforming and beamsteering.

6. The electrooptical radio frequency phase shifter of claim 1 wherein said electrooptical radio frequency phase shifter comprises one in a series of electrooptical radio frequency phase shifters that are interconnected for radio beamforming and beamsteering.

7. The electrooptical radio frequency phase shifter of claim 6 wherein a computer is used to control the series of electrooptical radio frequency phase shifters in order to promote controlled beamforming.

8. A microwave phase shifter comprising:
(a) a laser light source for generating a light wave having a phase and a frequency, along a primary optical path;
(b) an optical path divider for dividing light in said primary optical path into first and second optical paths;
(c) an optical frequency shifter associated with said first optical path for conforming light along said first optical path to a desired antenna radiation frequency;
(d) a stable microwave oscillator for driving said optical frequency shifters at the desired antenna frequency;
(e) an optical phase modulator adjusted to selectively advance and retard the phase of light along said second optical path;
(f) superimposition means for making a spatial and temporal combination of light from said first and said second optical path into a combined optical path; and
(g) a photodetector for converting light interference pulses from said combined optical path into electronic pulses.

9. The microwave phase shifter of claim 8 wherein said electronic pulses are used to beamform a microwave transmission at an antenna.

10. The microwave phase shifter of claim 8 further comprising an auxiliary optical phase modulator for trimming the output phase of said microwave phase shifter.

11. The microwave phase shifter of claim 8 further comprising an antenna having an array of individual radiators wherein several of said microwave phase shifters permit phased microwave transmission from said antenna.

12. The microwave phase shifter of claim 8 wherein said photodetector is a square law detector.

13. The microwave phase shifter of claim 8 wherein said superimposition means produced a coherent spatial and temporal combination of light from said first and said second optical path.

14. An optically steered antenna comprising:
(i) an array of individual microwave radiators each driven by an array of electronic microwave drivers;
(ii) a network of optical phase shifters arranged on an integrated optical chip for supplying a control signal to said electronic microwave drivers in order to generate microwave radiation at said microwave radiators wherein said optical phase shifters comprise:
(a) a laser light source for generating a light wave having a phase and frequency, along primary optical path,
(b) an optical path divider for dividing light in said primary optical path into first and second optical paths,
(c) an optical frequency shifter associated with said first optical path for conforming light along said first optical path to a desired antenna radiation frequency,
(d) a stable microwave oscillator for driving said optical frequency shifters at the desired antenna frequency,
(e) an optical phase modulator adjusted to selectively advance and retard the phase of light along said second optical path,
(f) superimposition means for making a spatial and temporal combination of light from said first and said second optical path into a combined optical path, and
(g) a photodetector for converting light interference pulses in light from said combined optical path into electronic pulses, and;
(iii) an array processor for controlling said network of optical phase shifters so as to produce directed microwave radiation with said antenna.

15. The optically steered antenna of claim 14 further comprises a receive-mode system for receiving and identifying by direction incoming microwave radiation, said receive mode system comprising:
(a) electronic modules for amplifying microwave signals received by said indivdual microwave radiators;

(b) a receiver network of optical phase shifters;

(c) a direction finding computer for initializing phases in the optical phase shifters of the receiver network of optical phase shifters in order to determine the directional origin of the incoming microwave radiation;

(d) photoelectric detectors for converting output signals from said optical phase shifters to electronic pulses; and (e) a receiver computer processor for interpreting the electronic pulses generated by said photoelectric detectors.

16. The optically steered antenna of claim 14 wherein said network of optical phase shifters are combined on an integrated optical circuit with optical waveguides.

17. The optically steered antenna of claim 14 wherein said integrated optical chip is combined with said individual microwave radiators and said array processor by means of single mode optical fibers.

* * * * *